United States Patent [19]

Richards

[11] 4,107,455

[45] Aug. 15, 1978

[54] LINEAR INSULATOR WITH ALTERNATING NONCONDUCTIVE SHEDS AND CONDUCTIVE SHIELDS

[76] Inventor: Clyde N. Richards, 4667 Ocean Blvd. Pacific Beach, San Diego, Calif. 92102

[21] Appl. No.: 802,661

[22] Filed: Jun. 2, 1977

[51] Int. Cl.[2] ..... H01B 17/42

[52] U.S. Cl. ..... 174/140 R; 174/179; 174/211

[58] Field of Search ..... 174/139, 140 R, 140 C, 174/140 H, 140 S, 140 CR, 141 R, 141 C, 144, 179, 211

[56] References Cited

U.S. PATENT DOCUMENTS

| | | | |
|---|---|---|---|
| 1,730,232 | 10/1929 | Newill | 174/141 R |
| 4,016,358 | 4/1977 | Richards | 174/141 R |

FOREIGN PATENT DOCUMENTS

| | | | |
|---|---|---|---|
| 332,963 | 2/1921 | Fed. Rep. of Germany | 174/141 R |
| 869,797 | 6/1961 | United Kingdom | 174/139 |

*Primary Examiner*—Laramie E. Askin
*Attorney, Agent, or Firm*—Bruno J. Verbeck

[57] ABSTRACT

An improved linear or rod insulator for electrically insulating a first electrical potential from a second electrical potential. The improved linear insulator comprising a nonconductive cylindrical linear core member having a conductive first mounting means secured to a first end of the core member and a conductive second mounting means secured to the second end of the core member. The first and second mounting means being attached to a first and a second electrical potential, respectively. The improved linear insulator further comprising a plurality of nonconducting disc shaped toroidal sheds coaxially secured to said core member, and a plurality of conducting bowl shaped toroidal shields coaxially secured to said core member and positioned alternatingly with said sheds so that each of said sheds is located intermediate two of said shields. The improved linear insulator may further include a linear resistance means extending the length of said core member and electrically attached to the first and second mounting means and to each of said conducting shields whereby said shields have an electrical potential determined by the magnitudes of said first and second electrical potentials and by the position said shields are attached to said resistance means.

10 Claims, 6 Drawing Figures

FIG. 2
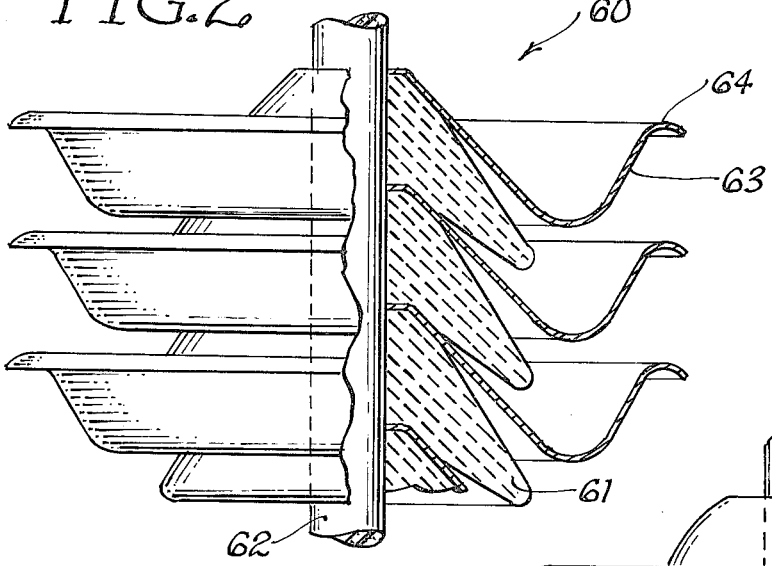
FIG. 3
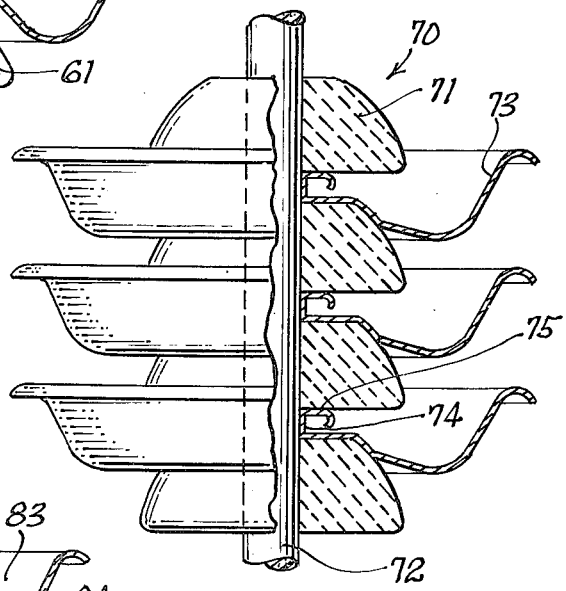
FIG. 4
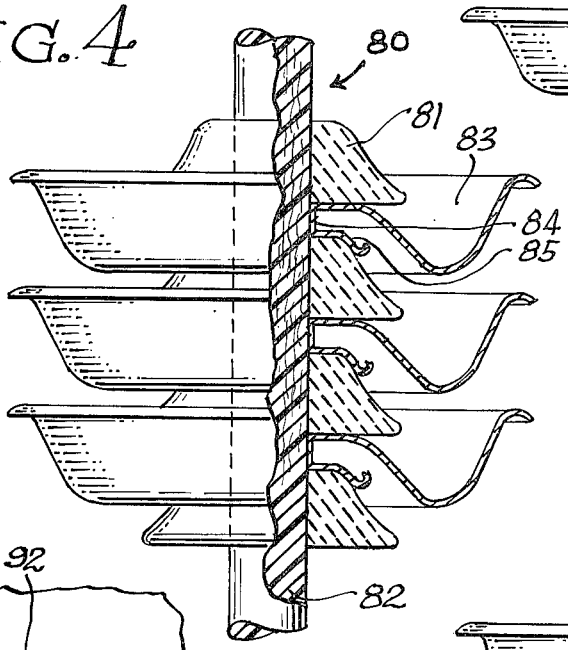
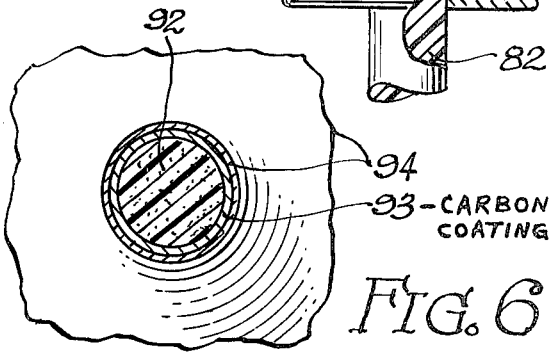
FIG. 6
FIG. 5
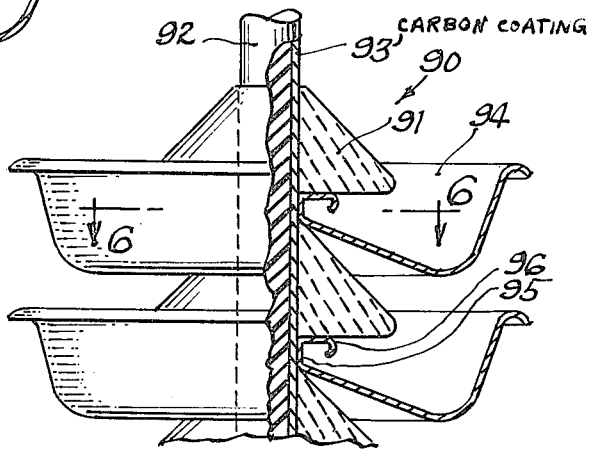

LINEAR INSULATOR WITH ALTERNATING NONCONDUCTIVE SHEDS AND CONDUCTIVE SHIELDS

BACKGROUND OF THE INVENTION

1. Field of the Invention

This invention relates to an improved linear insulator for electrically insulating different electrical potentials such as exist between high voltage power lines and support structures. Insulators of this type, often referred to as rod insulators, are typically long, upwards of 10 to 15 feet, and provide high tensile strength to support heavy objects, such as large power lines which are suitable for carrying electrical potentials of 500 KV and higher. Generally, the linear insulators provide comparable insulating characteristics as the conventional porcelain insulators (see U.S. Pat. No. 1,972,613) and have improved pollution resistance (see Electrical World, Sept. 1, 1976, pages 44–45).

2. Description of the Prior Art

Conventional linear or rod insulators are fabricated as a single unit and consist of a nonconductive cylindrical linear core member and a plurality of coaxially attached nonconductive toroidal weather sheds. The core member may be fabricated out of fiberglass, epoxy, or Kevlar (trademark material) to provide the required tensile strength. The weather sheds come in a variety of shapes which are principally designed to increase the leakage path between the two electrical potentials at either end of the linear insulator, and may be fabricated out of nonconducting porcelain, ceramic, or polymer materials.

None of the prior art linear insulators with which I am familiar provides adequate protection from the build-up of atmospheric contamination and the resulting deterioration of insulating performance. Further, none of the prior art linear insulators imposes a controlled gradient of electrical potential along the body of the insulator.

U.S. Pat. No. 4,016,358 does show a series of conventional ceramic insulators with incorporated contamination and flash-over eliminators; however, no device is known which provides contamination control for the linear insulator, and no device is known which imposes a control gradient of electrical potential by a single appliance or apparatus.

SUMMARY OF THE INVENTION

This invention relates to a new and unique linear or rod insulator for electrically insulating two electrical potentials, and providing increased protection against atmospheric contamination as well as a controlled gradient of electrical potential along the length of the insulator.

The improved linear insulator comprises a high tensile strength core member, having a first and second mounting means secured to the first and second ends, respectively, of the core member and a plurality of nonconducting disc shaped toroidal weather sheds coaxially secured to the core member. The improved insulator further comprises a plurality of conducting bowl shaped shields coaxially secured to said core member. The sheds are alternatingly positioned between the shields so that each shed is located intermediate two of said shields.

The bowl shaped shield member includes an outer perimeter which extends up above the level of the lower portion of the shed immediately above to provide improved resistance to atmospheric contamination.

Each of said conducting shields is in contact with the lower side of the central portion of the adjacent upper shed, with the core member, and with the upper side of the central portion of the adjacent lower shed. Each of said shields arcs gradually away from the lower side of the upper shed and from the upper side of the lower shed, respectively. Thus each shed has the central portion of its upper surface in contact with the conductive shield above and the central portion of the lower surface in contact with the conductor shield below producing a capacitor type element. The plurality of alternating shields and sheds produce a series of individual capacitor elements that provide a controlled gradient of electrical potential between the first and second mounting means and the respective first and second electrical potentials.

An alternate embodiment of the improved linear insulator includes a linear resistance means distributed along the length of the core member and attached to the first and second mounting means whereby to establish a further controlled gradient of electrical potentials between said first and second mounting means. The conductor shields are electrically attached to the resistance means so that the electrical potential of each of said electrical shields is determined by the position along said resistance means at which each of said electrical shields is attached.

It is therefore an object of this invention to provide an improved linear insulator which exhibits increased resistance to atmospheric contamination and further exhibits a controlled gradient of electrical potential along said linear insulator. A further object of this invention is to provide an improved linear insulator which allows current to flow between the two ends of the insulator. A further object of this invention is to provide an improved linear insulator which is suitable for insulating either alternating current power sources or direct current power sources.

BRIEF DESCRIPTION OF THE DRAWINGS

The following is a brief description of the accompanying drawings.

FIG. 2 is an elevation, partially in section, of the improved linear insulator having a hollow coned shaped shed member.

FIG. 3 is an elevation, partially in section, of the improved linear insulator having separated umbrella shaped sheds.

FIG. 4 is an elevation, partially in section, of the improved linear resistance insulator having separated bell shaped sheds.

FIG. 5 is a partial elevation, partially in section, of an improved linear resistance insulator having separated cone shaped sheds and a surface resistance means.

FIG. 6 is a sectional view taken along the line 6—6 of FIG. 5 of the improved linear resistance insulator having the surface resistance means.

DESCRIPTION OF THE PREFERRED EMBODIMENT

Figure 1:
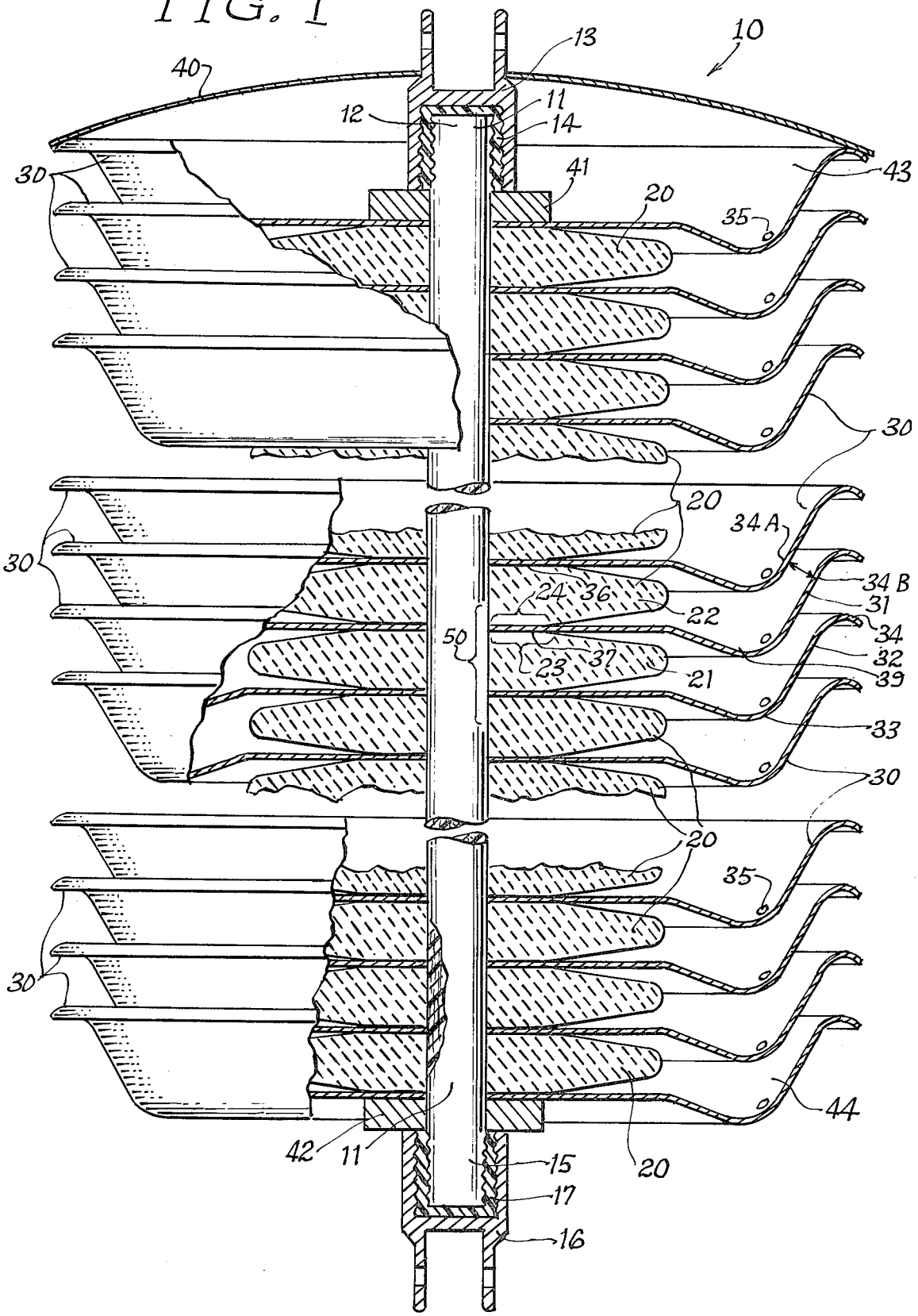
FIG. 1 is an elevation, partially in section, of the improved linear insulator.

FIG. 1 of the drawings is an elevation, partially in section, of the improved linear insulator for electrically insulating a first and a second electrical potential and is shown generally at 10. The improved linear insulator 10 includes a nonconducting (dielectric) cylindrical linear core member 11 which is generally fabricated out of fiberglass; however, other materials with high tensile strength, such as epoxy and Kevlar (a trademark material) may be used. The upper or first end 12 of the core member 11 of the linear insulator 10 is secured to upper or first mounting means 13 by any suitable securing means 14 such as epoxy. Similarly, the lower or second end 15 of the core member 11 is secured to the lower or second mounting means 16 by any suitable securing means 17. The first and second mounting means 13 and 16, respectively, are adapted so that they can be attached to the first and second electrical potentials (not shown), respectively, such as high voltage transmission lines and support structures.

The improved linear insulator 10 further includes a plurality of nonconducting (dielectric) disc shaped toroidal weather sheds 20 which are coaxially secured to the core member 11. As shown, the sheds 20 may be press fitted over the core member 11 and secured by the friction resulting from the closeness of the fit or, alternatively, they may be secured to the core member by some securing means, such as epoxy (not shown). It is, however, necessary that there be full and continuous circumferential contact between the core member 11 and the shed 20.

Also included in the improved linear insulator 10 is a plurality of conducting noncorrosive bowl shaped shields 30. The shields 30 are coaxially secured to the core member 11 and alternatingly positioned with the sheds 20 so that each shed, for example sample shed 21, is positioned intermediate two shields, for example, sample upper shield 31 and sample lower shield 32.

Improved resistance to atmospheric contamination is provided by the nesting effect of the shields 30 which is caused by the brim 39 extending radially outward from the core member 11 and slightly downward to the lowest point 33 which is outside the perimeter of the sheds 20. The brim 39 then curves gradually upward and at the outer edge curves outwardly and downwardly again to form an outer lip 34. As with each of said shields 30, the lip 34 of the sample lower shield 32 is above and outside the lower portion of the immediately superior sample shed 21.

Each of said shields 30 is in full and continuous circumferential contact with the core member 11. Further, each of said shields 30, for example sample upper shield 31, makes contact with the central portion of the upper surface 23 of the immediately lower sample shed 21 and makes contact with the central position of the lower surface 24 of the immediately upper sample shed 22. The orientation of the series of shields 30 in contact with the series of sheds 20 produces a sequence of capacitor type elements 50. Each of said capacitor elements 50 includes an upper shield portion 36 in contact with a nonconductive central shed portion 22 which is in contact with a lower shield portion 37. The sequence of substantially equal sized capacitor elements 50, provided by the series of alternating shields 30 and sheds 20, produces a controllable gradient of electrical potential between the first electrical potential attached to the first mounting means 13 and the second electrical potential attached to the second mounting means 16.

A first conducting means 41, such as a metallic washer, is provided to conduct the electrical potential of the first electrical potential to the uppermost shield 43 and a second conducting means 42 is provided to conduct the electrical potential of the second electrical potential to the lowermost shield 44.

Further, the contact between the shields 30 and the sheds 20 forces centers of high electrical field concentration around the core member 11 at the center portions of the sheds 20, to be dissipated and dispersed by the shields 30 and thus reduces the tendency for flashover between adjacent sheds 20. This dissipation of electrical field concentrations is particularly beneficial when the sheds 20 become contaminated by atmospheric conditions.

The nesting effect of the series of sheds 20 substantially improves the resistance of the improved linear insulator 10 to atmospheric contamination. The structure of the shields 30 prevents discharges or flash-overs from occurring between the sheds 20 and this prevents the destruction or substantial reduction of the effectiveness of the sheds 20. Flash-over discharges, generally caused by line surges or because of lightning striking power lines, occur at the closest point between adjacent structures. The disclosed structure of the improved linear insulator presents the closest point between consecutive shields 30 at, for example, points 34A and 34B which points are outside the radius of the sheds 20. The position of the closest point between consecutive shields 30 is controlled by the shape of the shields 30 and the incline of the outer brim 39 of the shield 30. By way of example only, a satisfactory configuration uses a closest point distance between consecutive shields 30 of approximately two-thirds, the height of an individual shed 20.

The shields 30 may be provided with circumferentially spaced openings 35 positioned above and outside the lowest point 33 of the shield 30, the openings 35 permitting the escape of rain water and accumulated contaminants. By way of example only , six openings 35 may be symmetrically spaced around each of said shields 30. The openings 35 may be circular holes whose diameter is approximately 0.125 inch. The openings 35 must be large enough to permit the escape of water, yet small enough to prevent a continuous and constant flow or stream of water that would electrically short adjacent shields 30. The openings 35 are not considered essential to the improved linear insulator 10, but are included where regional atmospheric conditions warrant.

A top plate 40 is shown over the uppermost shield 43 to prevent the collection of water and other debris. Further, the improved linear insulator is suitable for operation at substantially an orientation to the vertical.

FIG. 2 is a partial elevation, partially in section, of a first alternate improved linear insulator 60, having a hollow cone shaped shed 61. The first alternate insulator 60 is functionally and operationally analogous to the improved linear insulator 10 shown in FIG. 1.

The first alternate insulator 60 includes a nonconductive core member 62 and a first mounting means (not shown) secured to the first end (not shown) of the core member 62, and a second mounting means (not shown) secured to the second end (not shown) of the core member 62 which are attached to the first and second electrical potentials (not shown), respectively. The first alternate insulator also includes a plurality of nonconductive, toroidal, hollow, cone-shaped sheds 61 coaxially secured to the core member 62. A plurality of conducting noncorrosive bowl shaped shields 63 are provided and are alternatingly positioned with said sheds 61 so that each of said sheds 61 is positioned intermediate two of said shields 63.

Each of said shields 63 is in full and continuous circumferential contact with the core member 62. The central portion of the upper surface of each shed 61 is in contact with the shield 63 immediately above said shed 61 and the central portion of the lower surface of each shed 61 is in contact with the shield 63 immediately below each of said sheds 61.

The bowl shaped shield 63 gradually arcs away from each of the opposed surfaces of the upper and lower sheds and extends radially downward then outwardly then upwardly forming a bowl shape. At the outer perimeter the shield 63 extends outwardly and downwardly again to form an upper lip 64. The lip 64 of each shield 63 is generally above the lower portion of the shed 61 immediately above said shields 63. The first alternate insulator 60 may include openings (not shown) and cover plates (not shown) where conditions warrant.

FIG. 3 is a partial elevation, partially in section, of a second alternate insulator 70 having space umbrella shaped sheds 71. Like the first alternate insulator 60 shown in FIG. 2, the second alternate insulator 70 is functionally and operationally analogous to the improved insulator 10 shown in FIG. 1. The second alternate insulator 70 includes a nonconductive core member 72, first and second mounting means (not shown) secured to first and second ends (not shown), respectively, which are attached to first and second electrical potentials (not shown), respectively. The second alternate insulator 70 further includes a plurality of conducting bowl shaped shields 73. The sheds 71 and shields 73 are alternatingly positioned so that each shed 71 is positioned intermediate two of said shields 73.

Because of the spacing between consecutive sheds 71, the shields have an inner upward vertical annular wall 74 and an outwardly extending radial lip 75 and are in full and continuous circumferential contact with said core member 72. The structure of the shield 73 is such that the inner portion of the upper surface of each of said sheds 71 is in contact with the shield 73 immediately above said sheds 71 and the inner portion of the lower surface of each of said sheds 71 is in contact with the shield 73 immediately below said sheds 71.

To dissipate and disperse the centers of high electrical field concentrations located adjacent the core member 72, the radial lip 75 of the shield 73 arcs gradually away from the lower surface of the shed 71 above, and the lower central portion of the bowl shaped shield 73 arcs gradually away from the upper surface of the shed 71 below.

The contact between an upper shield 73, the central portion of the shed 71, and a lower shield 73 produces a capacitor type element which, because of the sequence of such capacitor elements, produces a controlled gradient of electrical potential along the length of the second alternate insulator 70.

FIG. 4 is a partial elevation, partially in section, of an improved linear resistance insulator 80 having spaced bell-shaped sheds 81. While the functional and operational features of the resistance insulator 80 are similar to those of the improved insulator 10 shown in FIG. 1, the resistance insulator 80 includes a cylindrical linear core member 82 which has an electrical resistance and passes current between the first electrical potential (not shown) through the first mounting means (not shown) which is secured to the first end of the core member 82, to the second electrical potential (not shown) and through the second mounting means (not shown) which is attached to the second end of the core member 82. The electrical resistance of the core member is a linear resistance and has a finite resistance per unit length over the entire length of the core member 82. The resistance of the core member 82 is determined such that the power consumed per linear foot of the core member 82 is less than about 1 watt, or that the total power consumed by the entire core member 82 is on the order of 10 watts or less. The resistance insulator 80 further includes a plurality of spaced nonconducting bell-shaped sheds 81 coaxially secured to said resistance core member 82 and a plurality of bowl shaped shields 83 coaxially secured to said resistance core member 82. The sheds 81 and the shields 83 are alternatingly positioned so that each of said sheds 81 is positioned intermediate two of said shields 83.

The spacing between consecutive sheds 81 is accommodated by a downward vertical annular wall 84 and an outwardly extending radial lip 85 of the shield 83 that gradually arcs away from the upper surface of the shed 81 immediately below each of said shields 83 (except for the lowermost shield). The shield 83 gradually arcs away from the lower surface of the shed 81 immediately above said shields 83 (except for the uppermost shield). The shield 83 is in full and continuous circumferential contact with the resistance core member 82.

The capacitor type elements of the sequence of sheds 81 and shields 83 are analogous to those of the improved linear insulator 10 shown in FIG. 1.

Electrical contact is made between each of said shields 83 and the resistance core member 82, whereby each of said shields assumes the electrical potential determined by the point of electrical contact with the linear resistance of the resistance core member 82. The combination of the sequence of substantially equal-valued capacitor elements and the electrical potential established by the electrical contact with the linear resistance of the resistance core member 82 provides the controlled gradient of electrical potential for the resistance insulator 80.

FIG. 5 is a partial elevation, partially in section, of a second alternate resistance insulator 90 having spaced cone shaped sheds 91. The alternate resistance insulator 90 includes a cylindrical linear core member 92 which has a linear electrical resistance carbon material 93 circumferentially coated along the length of the core member 92 so that current passes between the first and second electrical potentials (not shown).

The circumferential resistance carbon material 93 provides a linear resistance which has a finite value over the length of the alternate resistance insulator 90 such that the power consumed is on the order of 10 watts.

The spaced nonconductive cone-shaped sheds 91 are coaxially secured to said core member 92 and a plurality of conducting bowl-shaped shields 94 are coaxially secured to the core member 92. The sheds 91 and the shields 94 are alternatingly positioned so that each of said sheds 91 is positioned intermediate two of said shields 94.

The spacing between consecutive sheds is accommodated by an upward vertical annular wall 95 and an outwardly extending radial lip 96 which gradually arcs away from the lower surface of the shed 91 immediately above said shields 94. Each of said shields 94 also arcs gradually away from the upper shed 91 immediately below said shields 94.

The shield 94 is in full circumferential contact with the resistance material 93 coated on the core member 92 making electrical contact with said resistance material. FIG. 6 is a sectional plan view showing the core member 92, the coated resistance material 93, and the conducting shield 94.

Returning to FIG. 5, the electrical contact of each of the shields 94 with the coated resistance material 93 and the sequence of capacitor elements produced by the alternating shields 94 and sheds 91 establishes the controlled gradient of electrical potential of the alternate resistance insulator 90.

It is understood that this description of my invention is done to fully comply with the requirements of 35 USC 112 and is not intended to limit my invention in any way. It can be seen from the above description that variant forms of the improved linear insulator and specifically the design of the sheds and shields and the resistance means easily be developed within the skill of the art. Therefore, such variant forms are considered to be within the scope and essence of my invention.

What is claimed is:

1. An improved linear insulator for electrically insulating a first electrical potential from a second electrical potential which comprises:

(a) a nonconductive core member having a first mounting means secured to one end of the core member for connecting to said first electrical potential and a second mounting means secured to the other end of the core member for connecting to said second electrical potential;

(b) a plurality of nonconducting sheds coaxially secured to the core member; and (c) a plurality of conducting shields coaxially secured to the core member and alternatingly positioned with said sheds so that each of said sheds is located intermediate two of said shields, the central portion of the upper surface of each of said sheds being in contact with the central portion of the shield immediately above said shed, and the central portion of the lower surface of each of said sheds being in contact with the central portion of the shield immediately below said shed, each of said shields extending radially outwardly and downwardly then upwardly so that the outer perimeter of the shield is outside the shed immediately above said shields.

2. The apparatus of claim 1 wherein said sheds are nonconducting, toroidal and disc-shaped.

3. The apparatus of claim 1 wherein said sheds are nonconducting, toroidal, and hollow cone-shaped.

4. The apparatus of claim 1 wherein said sheds are spaced apart and wherein each of said shields includes an upwardly extending vertical annular wall and an upper radially extending lip, said upwardly extending wall being in full and continuous circumferential contact with said core member, the radial lip of each of said shields being in contact with the inner portion of the lower surface of the shed immediately above each of said shields, and gradually arcing away from said lower surface, and said shield being in contact with the inner portion of the upper surface of the shed immediately above each of said shields and gradually arcing away from said upper surface.

5. The apparatus of claim 1 wherein said sheds are spaced apart and wherein each of said shields includes a downwardly extending vertical annular wall and a lower radially extending lip, said downwardly extending wall being in full and continuous circumferential contact with said core member, the radial lip of each of said shields being in contact with the inner portion of the lower surface of the shed immediately above each of said shields, and gradually arcing away from said lower surface, and said shield being in contact with the inner portion of the upper surface of the shed immediately above each of said shields and gradually arcing away from said upper surface.

6. The apparatus of claim 1 which further comprises a means for effecting electrical contact between the first electrical potential and the uppermost shield, and means for effecting electrical contact between the second electrical potential and the lowermost shield.

7. The apparatus of claim 1 wherein said core member further comprises a linear resistance means extending the length of the core member, said resistance means being for passing current between the first electrical potential and the second electrical potential.

8. The apparatus of claim 7 wherein each of said shields is in electrical contact with said resistance means.

9. The apparatus of claim 8 wherein said resistance means is a high resistance carbon material deposited over the surface of said core member.

10. The apparatus of claim 1 wherein said outer perimeter of each of said shields extends outside and above the lower portion of the shed immediately above each of said shields.

* * * * *